US005545263A

United States Patent [19]

Yoshitomi et al.

[11] Patent Number: 5,545,263

[45] Date of Patent: Aug. 13, 1996

[54] PROCESS FOR PRODUCTION OF GRAIN ORIENTED ELECTRICAL STEEL SHEET HAVING SUPERIOR MAGNETIC PROPERTIES

[75] Inventors: Yasunari Yoshitomi, Kitakyushu; Takehide Senuma, Sagamihara; Yozo Suga; Nobuyuki Takahashi, both of Kitakyushu, all of Japan

[73] Assignee: Nippon Steel Corporation, Tokyo, Japan

[21] Appl. No.: 246,918

[22] Filed: May 20, 1994

Related U.S. Application Data

[63] Continuation of Ser. No. 13,129, Feb. 3, 1993, abandoned, which is a continuation of Ser. No. 833,805, Feb. 10, 1992, abandoned, which is a continuation of Ser. No. 503,733, Apr. 3, 1990, abandoned.

[30] Foreign Application Priority Data

Apr. 4, 1989 [JP] Japan ..... 1-85540
Apr. 4, 1989 [JP] Japan ..... 1-85541

[51] Int. Cl.[6] ..... C21D 8/12

[52] U.S. Cl. ..... 148/111; 148/112

[58] Field of Search ..... 148/111, 112, 148/113

[56] References Cited

U.S. PATENT DOCUMENTS 5,039,359 8/1991 Yoshitomi et al. ..... 148/111
5,261,971 11/1993 Yoshitomi et al. ..... 148/112

FOREIGN PATENT DOCUMENTS 0098324 1/1984 European Pat. Off. .
2133742 12/1972 France .
2016987 10/1979 United Kingdom .

OTHER PUBLICATIONS

Patent Abstracts of Japan, vol. 6, No. 250 (C–139) [1128], Dec. 9, 1982, publication No. 57–145931.

Patent Abstracts of Japan, vol. 9, No. 301 (C–316) [2024], Nov. 28, 1985, publication No. 60–138014.

*Primary Examiner*—George Wyszomierski
*Attorney, Agent, or Firm*—Kenyon & Kenyon

[57] ABSTRACT

In the present invention, a slab of a silicon steel comprising usual components is hot-rolled while adjusting the hot rolling-finish temperature at 750° to 1150° C. and the cumulative reduction ratio of final three passes to at least 40%, or the above-mentioned silicon steel slab is hot-rolled at the above-mentioned hot rolling-finish temperature, the hot-rolled steel sheet is held at a temperature not lower than 35° C. lower than the finish temperature for at least 1 second, and the steel sheet is wound at a winding temperature lower than 700° C. Successively, the hot-rolled steel sheet is subjected, without annealing of the hot-rolled steel sheet, to cold rolling at a reduction ratio of at least 80%, decarburization annealing, and final finish annealing. According to this process, a grain oriented electrical steel sheet having superior magnetic properties can be prepared.

4 Claims, 10 Drawing Sheets

HOT ROLLING CONDITIONS (A)

RECRYSTALLIZATION RATIO (%) (POSITION OF 1/4 THICKNESS): 94

HOT ROLLING CONDITIONS (B)

RECRYSTALLIZATION RATIO (%) (POSITION OF 1/4 THICKNESS): 21

HOT ROLLING CONDITIONS (C)

RECRYSTALLIZATION RATIO (%) (POSITION OF 1/4 THICKNESS):65

HOT ROLLING CONDITIONS (D)

RECRYSTALLIZATION RATIO (%) (POSITION OF 1/4 THICKNESS):20

HOT ROLLING CONDITIONS (E)

RECRYSTALLIZATION RATIO (%) (POSITION OF 1/4 THICKNESS):100

HOT ROLLING CONDITIONS (F)

RECRYSTALLIZATION RATIO (%) (POSITION OF 1/4 THICKNESS):38

PROCESS FOR PRODUCTION OF GRAIN ORIENTED ELECTRICAL STEEL SHEET HAVING SUPERIOR MAGNETIC PROPERTIES

This application is a continuation of Ser. No. 08/013,129, filed on Feb. 3, 1993, which is a continuation of Ser. No. 07/833,805, filed on Feb. 10, 1992, which is a continuation of Ser. No. 07/503,733, filed on Apr. 3, 1990, all abandoned.

BACKGROUND OF THE INVENTION (1) Field of the Invention

A grain oriented electrical steel sheet is mainly used as an iron core material of an electrical equipment such as a transformer or the like, and the steel sheet is required to have superior magnetic properties such as good exciting and watt loss characteristics. A magnetic flux density $B_8$ at a magnetic field intensity of 800 A/m is usually used as the numerical value showing the exciting characteristic, and the watt loss $W_{17/50}$ per kg observed when the sample is magnetized at a frequency of 50 Hz to 1.7 tesla (T) is used as the numerical value showing the watt loss characteristic. The magnetic flux density is the most dominant factor for the watt loss characteristic, and in general, the higher the magnetic flux density, the larger the secondary recrystallized grain diameter and the more unsatisfactory the watt loss characteristic. Nevertheless, by control of the magnetic domain, the watt loss characteristic can be improved regardless of the secondary recrystallized grain diameter.

This grain oriented electrical steel sheet is prepared by developing a Goss structure having a (110) plane on the surface of the steel sheet and a <001> axis in the rolling direction by causing the secondary recrystallization at the final finish annealing step. To obtain good magnetic properties, the <001> axis, which is the easy magnetization axis, must agree precisely with the rolling direction. The directionality of the secondary recrystallized grains can be greatly improved by the method in which MnS, AlN or the like is utilized as the inhibitor and final rolling is carried out under a high reduction ratio, and as a result, the watt loss characteristic is greatly improved.

In the production of a grain oriented electrical steel sheet, annealing of a hot-rolled sheet is generally carried out after hot rolling for a uniformation of the structure and precipitation. For example, in the process using AlN as the main inhibitor, at the step of annealing a hot-rolled sheet, a treatment for the precipitation of AlN is carried out to control the inhibitor, as disclosed in Japanese Examined Patent Publication No. 46-23820.

In general, a grain oriented electrical steel sheet is prepared through main steps such as casting, hot rolling, annealing, cold rolling, decarburization annealing, and finish annealing, the production consumes a large quantity of energy, and therefore, the manufacturing costs are higher than in the usual steel production process.

Recently, improvements have been made in this production process consuming a large quantity of energy, and demands for a simplification of the steps and reduction of the energy consumption are now increasing. As the means for satisfying this desire, there has been proposed a process in which in the production method using AlN as the main inhibitor, the precipitation of AlN at the step of annealing a hot-rolled sheet is replaced by the high-temperature winding after hot rolling (Japanese Examined Patent Publication No. 59-45730). Indeed, in this process, the magnetic properties can be maintained to some extent even if the step of annealing a hot-rolled sheet is omitted, but in the usual process where the sheet is wound in the form of a coil having 5 to 20 tons, a positional difference of the heat history is brought about in the coil during the cooling step, and thus the precipitation of AlN is inevitably uneven and the final magnetic properties differ according to parts in the coil, resulting in lowering of the yield.

Under this background, the inventors noted the recrystallization phenomenon after the final pass of finish hot rolling, which was little taken into account in the conventional technique, and examined a process of omitting the step of annealing a hot-rolled sheet by utilizing this phenomenon in the method of carrying out cold rolling once at a reduction ratio higher than 80%.

In connection with hot rolling of a grain oriented magnetic steel sheet, as the means for preventing an insufficient secondary recrystallization (formation of linear micrograins continuous in the rolling direction) caused by coarsening and growth of crystal grains of the slab at the step of heating the slab at a high temperature (for example, at a temperature not lower than 1300° C.), there has been proposed a process in which, at the hot rolling step, the high reduction rolling for promoting crystallization is carried out at a temperature of 960° to 1190° C. at a reduction of at least 30% per pass to divide coarse crystal grains (Japanese Examined Patent Publication No. 60-37172). According to this proposal, the formation of linear micrograins can be controlled, but a production process comprising the carrying out of the annealing of a hot-rolled sheet is the premise thereof.

In the production process using MnS, MnSe or Sb as the inhibitor, there has been proposed a method in which the magnetic properties are improved by continuously carrying out hot rolling at a temperature of 950° to 1200° C. and a reduction ratio of at least 10% and then cooling the sheet at a cooling rate not lower than 3° C./sec to precipitate MnS, MnSe or the like uniformly and finely (Japanese Unexamined Patent Publication No. 51-20716). Furthermore, there has been proposed a method in which hot rolling is carried out at a low temperature to control the advance of recrystallization and the magnetic properties are improved by preventing the (110)<001> oriented grains formed by shear deformation from being reduced by the subsequent recrystallization (Japanese Examined Patent Publication No. 59-32526 and Japanese Examined Patent Publication No. 59-35415). In these conventional techniques, the production by single cold rolling without annealing of a hot-rolled sheet is not even examined. In connection with the hot rolling of a silicon steel slab having an ultra-low carbon content, there has been proposed a method in which hot rolling under high reduction at a low temperature, which results in an accumulation of strain in the hot-rolled sheet, is carried out, and by the recrystallization at the subsequent annealing of the hot-rolled sheet, coarse crystal grains, characteristic of an ultra-low carbon content material, are divided (Japanese Examined Patent Publication No. 59-34212). But the production comprising an one stage cold rolling without the annealing of the hot-rolled sheet is not examined in this method.

SUMMARY OF THE INVENTION

A primary object of the present invention is to obtain a grain oriented electrical steel sheet having excellent magnetic properties by an one stage cold rolling process while omitting the annealing of a hot-rolled steel sheet.

According to the present invention, the recrystallization phenomenon after the final pass of finish hot rolling, which has attracted little attention, is utilized for attaining this object.

More specifically, hot rolling of a silicon steel slab having an ordinary composition is carried out while adjusting the hot rolling finish temperature of 750° to 1150° C. and specifying the cumulative reduction ratio of the final pass or after the hot rolling, the hot-rolled steel sheet is maintained at a predetermined temperature for a predetermined time and is then wound, whereby the recrystallization of the hot-rolled steel sheet is advanced to reduce the strain in the hot-rolled steel sheet, or the crystal grain diameter is made finer. By the cold rolling recrystallization of the hot-rolled steel sheet, good magnetic properties can be obtained even while omitting the annealing of the hot-rolled steel sheet.

Namely, the present invention is characterized in that hot rolling of a silicon steel slab is carried out at a hot rolling-finish temperature of 750° to 1150° C. while adjusting the cumulative reduction ratio of final three passes to at least 40%, and the hot-rolled steel sheet is subjected to cold rolling at a reduction ratio of at least 80% without annealing of the hot-rolled steel sheet and then to decarburization annealing and final finish annealing.

By dint of another feature of adjusting the reduction ratio of the final pass at the finish hot rolling to at least 20%, as well as the above-mentioned characteristic feature, a grain oriented electrical steel sheet having further improved magnetic properties can be obtained.

In another case, the present invention is characterized in that a silicon steel slab is hot-rolled at a hot rolling-finish temperature to 750° to 1150° C., the hot-rolled steel sheet is maintained at a temperature not lower than 700° C. for at least 1 second after termination of the hot rolling, the winding temperature is controlled below 700° C., and the hot-rolled steel sheet is then subjected to cold rolling at a reduction ratio of at least 80% without annealing of the hot-rolled steel sheet, and then to decarburization annealing and final finish annealing.

By dint of another feature of adjusting the cumulative reduction ratio at the final three passes of the finish hot rolling to at least 40%, as well as the above-mentioned characteristic feature, a grain oriented magnetic steel sheet having further improved magnetic properties can be obtained.

Furthermore, by dint of still another feature of adjusting the reduction ratio at the final pass of the finish hot rolling to at least 20%, as well as the above-mentioned two characteristic features, a grain oriented electrical steel sheet having much further improved magnetic properties can be obtained.

DESCRIPTION OF THE PREFERRED EMBODIMENTS

The present invention will now be described in detail with reference to the following embodiments.

The method of specifying the cumulative reduction ratio at the final pass (hereinafter referred to as "reduction ratio-adjusting method") will now be described in detail with reference to the experimental results.

Figure 1:
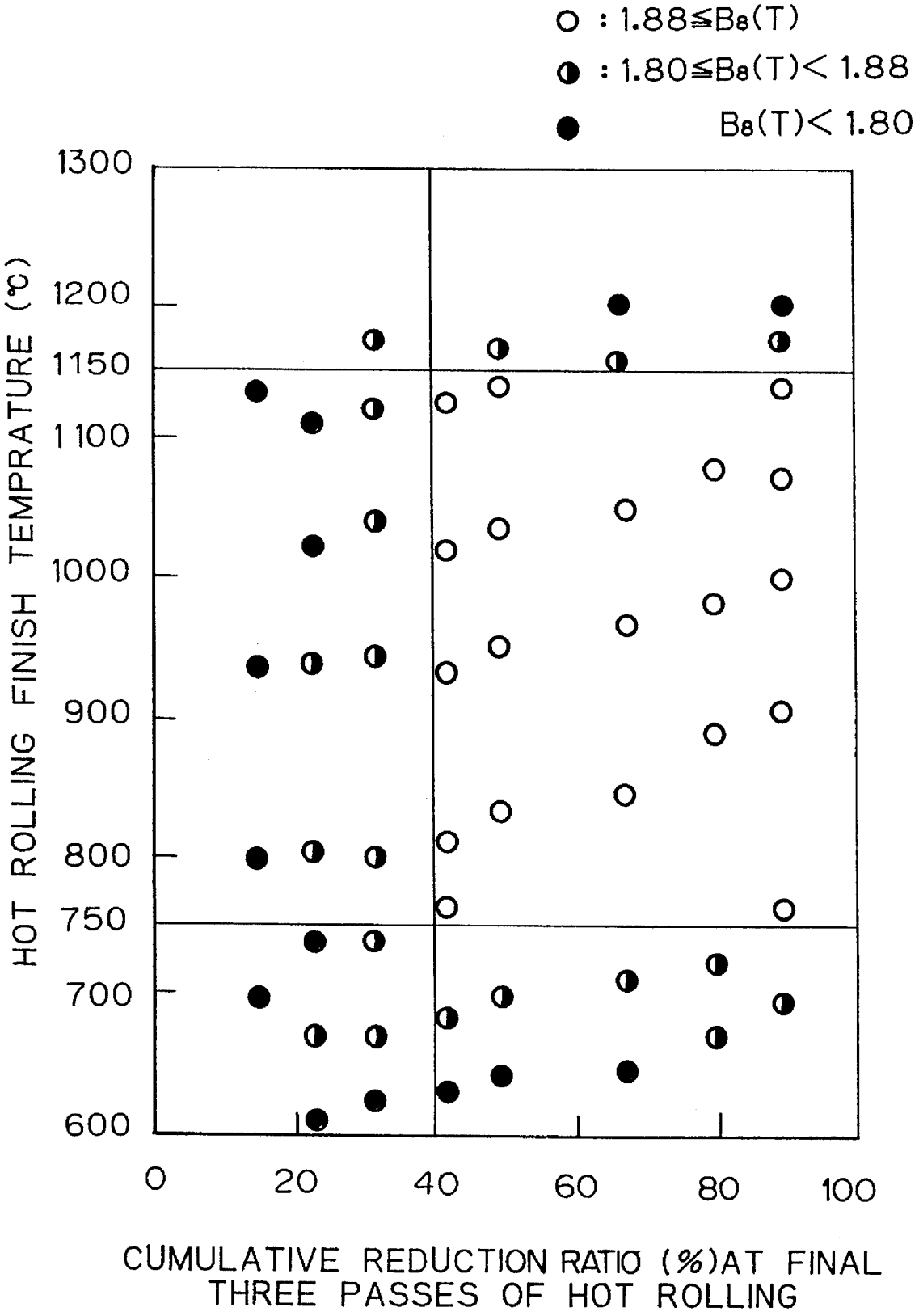
FIG. 1 is a graph showing influences of the hot rolling-finish temperature and the cumulative reduction ratio at final three passes of the hot rolling on the magnetic flux density of the product.

FIG. 1 is a graph illustrating the influences of the hot rolling-finish temperature and the cumulative reduction ratio at the final three passes on the magnetic flux density of the product. Namely, a slab having a thickness of 20 to 60 mm, which comprised 0.054% by weight of C, 3.25% by weight of Si, 0.027% by weight of acid-soluble Al, 0.0080% by weight of N, 0.007% by weight of S and 0.14% by weight of Mn, with the balance comprising Fe and unavoidable impurities, was heated at 1150° to 1400° C. and hot-rolled to a hot-rolled sheet having a thickness of 2.3 mm through 6 passes. After about 1 second, the hot-rolled sheet was cooled with water and was subjected to a winding simulation where the sheet was cooled to 550° C. and maintained at 550° C. for 1 hour to effect furnace cooling. Rolling at a high reduction rate was carried out at a reduction ratio of about 85% without annealing the hot-rolled sheet, whereby a cold-rolled sheet having a final thickness of 0.335 mm was prepared. Then, decarburization annealing was carried out at a temperature of 830° to 1000° C., an anneal separating agent composed mainly of MgO was coated on the sheet, and a final finish annealing was carried out.

As apparent from FIG. 1, when the hot rolling-finish temperature was 750° to 1150° C. and the cumulative reduction ratio at the final three passes was at least 40%, a high magnetic flux density of $B_8 \geqq 1.88$ T was obtained.

Figure 2:
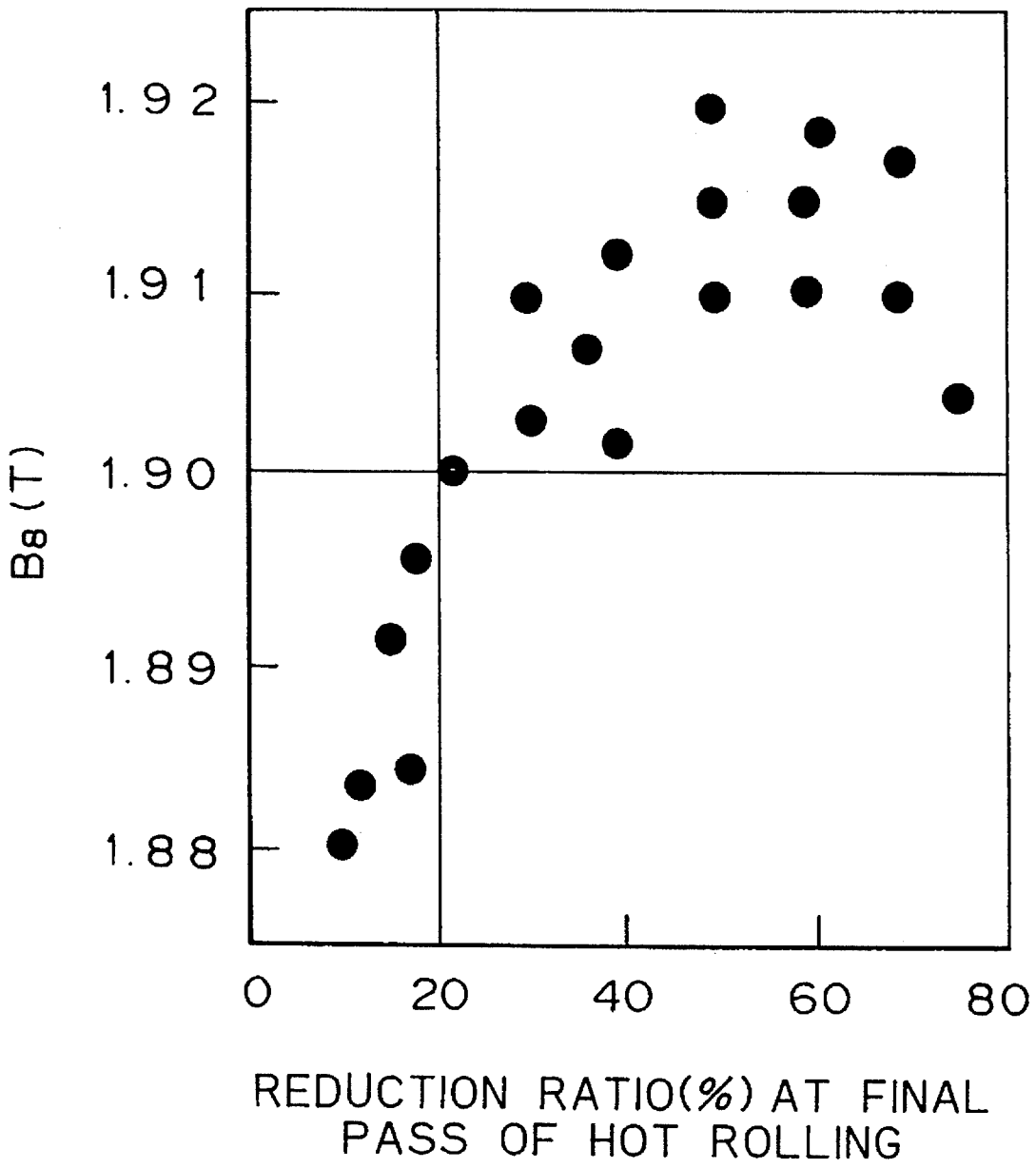
FIG. 2 is a graph showing influences of the reduction ratio at the final pass of hot rolling on the magnetic flux density of the product.

FIG. 2 is a graph showing the relationship between the reduction ratio at the final pass of the hot rolling and the magnetic flux density, observed in runs giving a better magnetic flux density in FIG. 1, where the hot rolling-finish temperature was 750° to 1150° C. and the cumulative reduction ratio at the final three passes was at least 40%.

As apparent from FIG. 2, if the reduction ratio at the final pass was at least 20%, a high magnetic flux density of $B_8 \geqq 1.90$ T was obtained.

The reason why the relationships shown in FIGS. 1 and 2 are established among the hot rolling-ending temperature, the cumulative reduction ratio at the final three passes, the reduction ratio at the final pass and the magnetic flux density has not been completely elucidated, but it is considered that the reason is probably as follows.

Figure 3A:
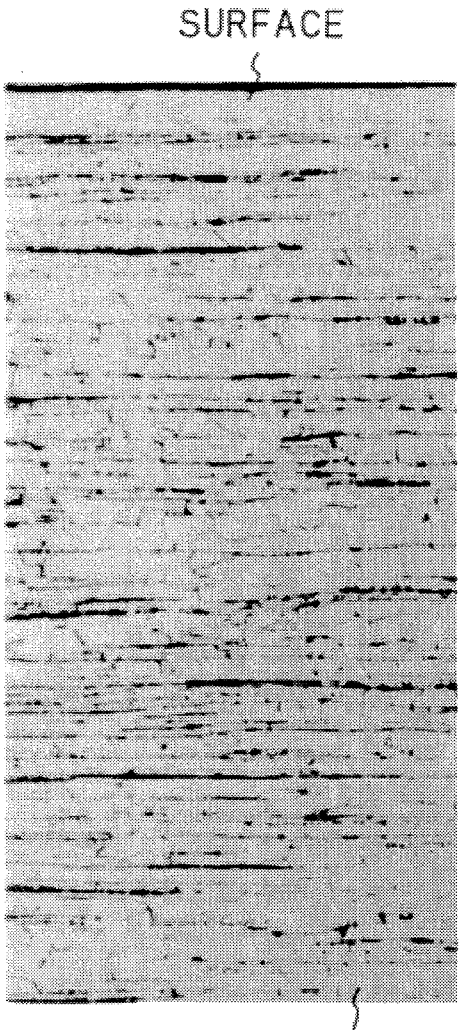
FIGS. 3(*a*) and 3(*b*) are microscope photos showing the microstructure of hot-rolled steel sheets obtained under hot-rolling conditions (A) and (B), respectively.
Figure 3B:
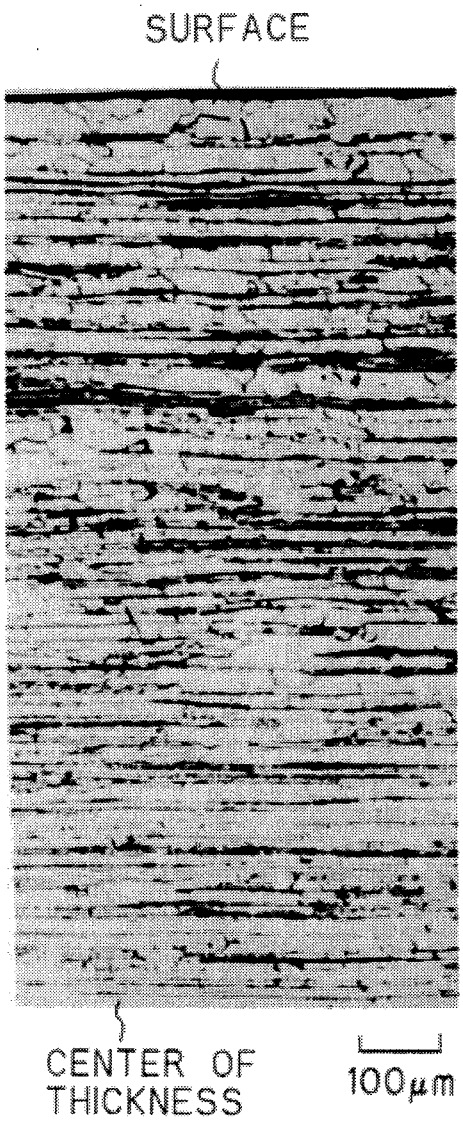

Microstructures of hot-rolled sheets prepared under different hot-rolling conditions and the textures after decarburization annealing (decarburized sheets) (at the point of ¼ thickness) are shown in FIGS. 3(*a*) and 3(*b*) and 4. Slabs having a thickness of 33.2 mm or 26 mm and having the same conditions as described above with respect to FIG. 1 were heated at 1150° C. and hot rolling was initiated at 1050° C., and hot-rolled sheets having a thickness of 2.3 mm were prepared through a pass schedule of a hot rolling conditions (A) 33.2 mm→18.6 mm→11.9 mm→8.6 mm→5.1 mm→3.2 mm→2.3 mm or a hot rolling conditions (B) 26 mm→11.8 mm→6.7 mm→3.5 mm→3.0 mm→2.6 mm→2.3 mm. The hot-rolled sheets were cooled under the same conditions as described above with respect to FIG. 1. The hot rolling-finish temperature was 935° C. at run (A) or 912° C. at run (B). Then, without performing annealing of the hot-rolled sheets, rolling under a high reduction rate was carried out at a reduction ratio of about 85% to obtain cold-rolled sheets having a final thickness of 0.335 mm. The cold-rolled sheets were maintained at 830° C. for 150 seconds in an atmosphere comprising 25% of $N_2$ and 75% of $H_2$ and having a dew point of 60° C. to effect carburization annealing.

Figure 4:
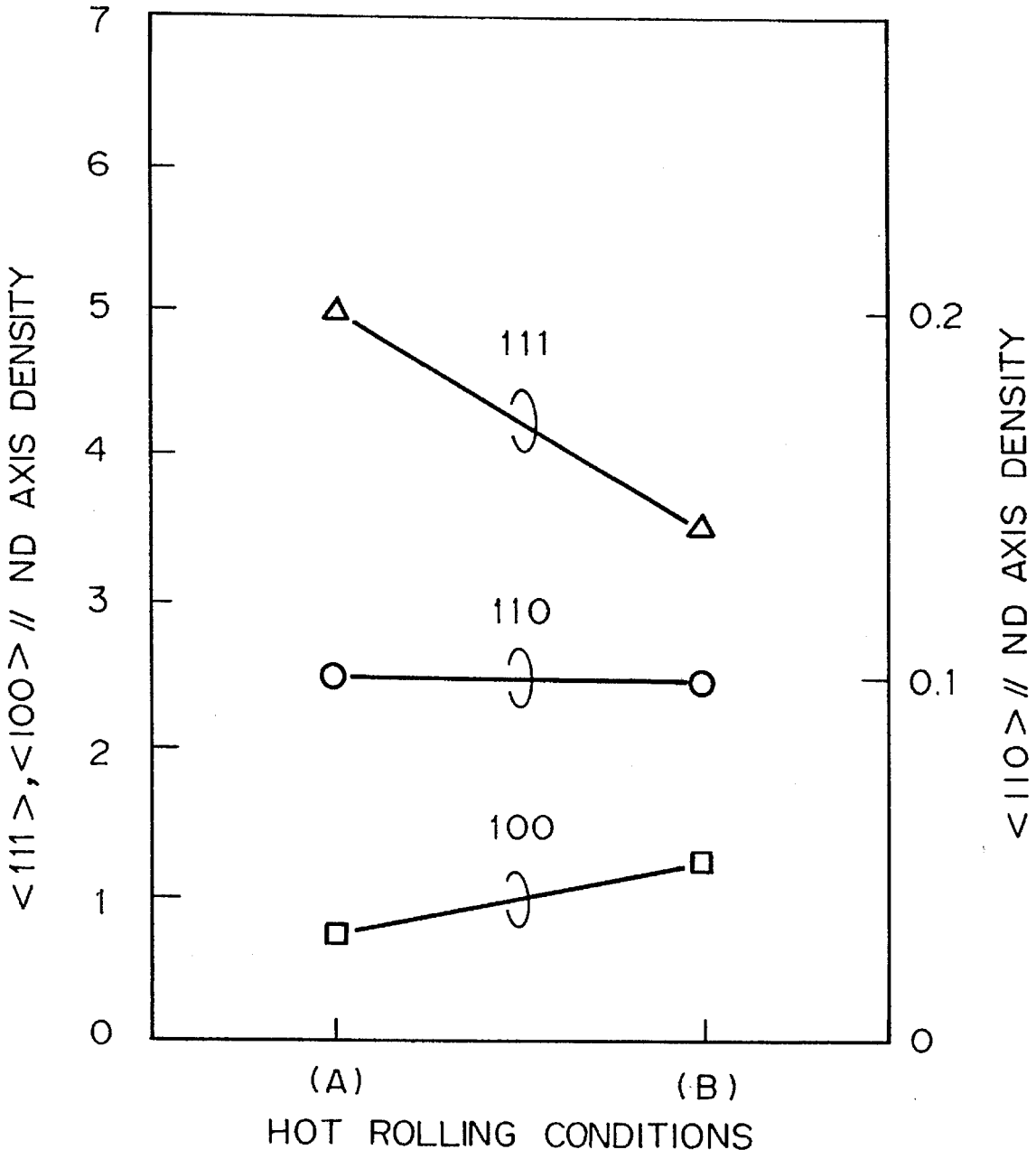
FIG. 4 is a graph showing the characteristics of textures of decarburized sheets obtained through hot-rolling conditions (A) and (B), respectively.

As apparent from FIGS. 3(*a*) and 3(*b*), at run (A) satisfying the conditions of the present invention, the recrystallization ratio was much higher and the crystal grain diameter was smaller than at run (B). Furthermore, as apparent from FIG. 4, at run (A) satisfying the conditions of the present invention, the number of {111} oriented grains in the decarburized sheet was larger and the number of {100} oriented grains was smaller than at run (B), and there was no substantial difference of the number of {110} oriented grains between the two runs. Note, the recrystallization ratio of the hot-rolled sheet (at the point of ¼ thickness) was determined by the method developed by the inventors [Collection of Outlines of Lectures at Autumn Meeting of Japanese Metal Association (November 1988), page 289], in which an image of ECP (electron channelling pattern) is analyzed to determine the crystal strain, and the area ratio of low-strain grains having a sharpness higher than that of ECP obtained when an anneal sheet of a reference sample is cold-rolled at a reduction ratio of 1.5% is determined as the recrystallization ratio. This method shows a much higher precision than the precision obtained by the conventional method in which the recrystallization ratio is determined by the visual judgement of the microstructure.

As apparent from FIGS. 3(*a*) and 3(*b*) and 4, at run (A) according to the present invention, the recrystallization ratio of the hot-rolled sheet was very high (the strain was small) and the crystal grain diameter was small, and when this hot-rolled steel sheet was cold-rolled and recrystallized, a texture in which the number of {111} oriented grains was increased and the number of {100} oriented grains was reduced was obtained without any influence of {110} oriented grains.

It has been considered that the potential nucleus of {110}<001> secondary recrystallized grains is formed by the shear deformation on the top surface layer at the hot rolling steel sheet, and that to enrich {110}<001> oriented grains in the hot-rolled steel sheet after the cold rolling recrystallization, a good effect can be obtained by keeping {110}<001> oriented grains in the hot-rolled steel sheet in the coarse and strain-reduced state. In the hot-rolled steel sheet of the present invention, the crystal grain diameter is small but the strain is reduced, and consequently, no influence is imposed on {110}<001> oriented grains after the decarburization annealing.

It is known that main orientations {111}<112> and {100}<025> of the decarburized steel sheet are orientations having influences on the growth of {110}<001> secondary recrystallized grains. It is considered that, as the number of {111}<112> oriented grains is large and the number of {100}<025> oriented grains is small, the growth of {110}<001> secondary recrystallized grains is facilitated. In the present invention, by applying a high reduction at final three passes, at the recrystallization subsequent to the final pass, the number of nucleus-forming sites is increased, and the recrystallization is advanced and the crystal grains are made finer. If the hot-rolled sheet of the present invention is subsequently cold-rolled and recrystallized, since the grain diameter before the cold rolling is small many {111}<112> oriented grains are nucleated at the vicinity of the grain boundary and the number of {100}<025> oriented grains is relatively decreased.

Accordingly, in the present invention, since by the recrystallization subsequent to the final pass of the hot rolling, the state where the strain is small and the crystal grain diameter is small is maintained, the number of {111}<112> oriented grains advantageous for the growth of {110}<001> oriented grains can be increased without any influence on {110}<001> oriented grains in the decarburized and annealed steel sheet, and the number of {100}<025> oriented grains inhibiting the growth of {110}<001> oriented grains can be decreased, whereby good magnetic properties can be obtained even if annealing of the hot-rolled steel sheet is omitted.

The holding treatment after completion of hot rolling (hereinafter referred to as "cooling step-adjusting method") will now be described in detail with reference to experimental results.

Figure 5:
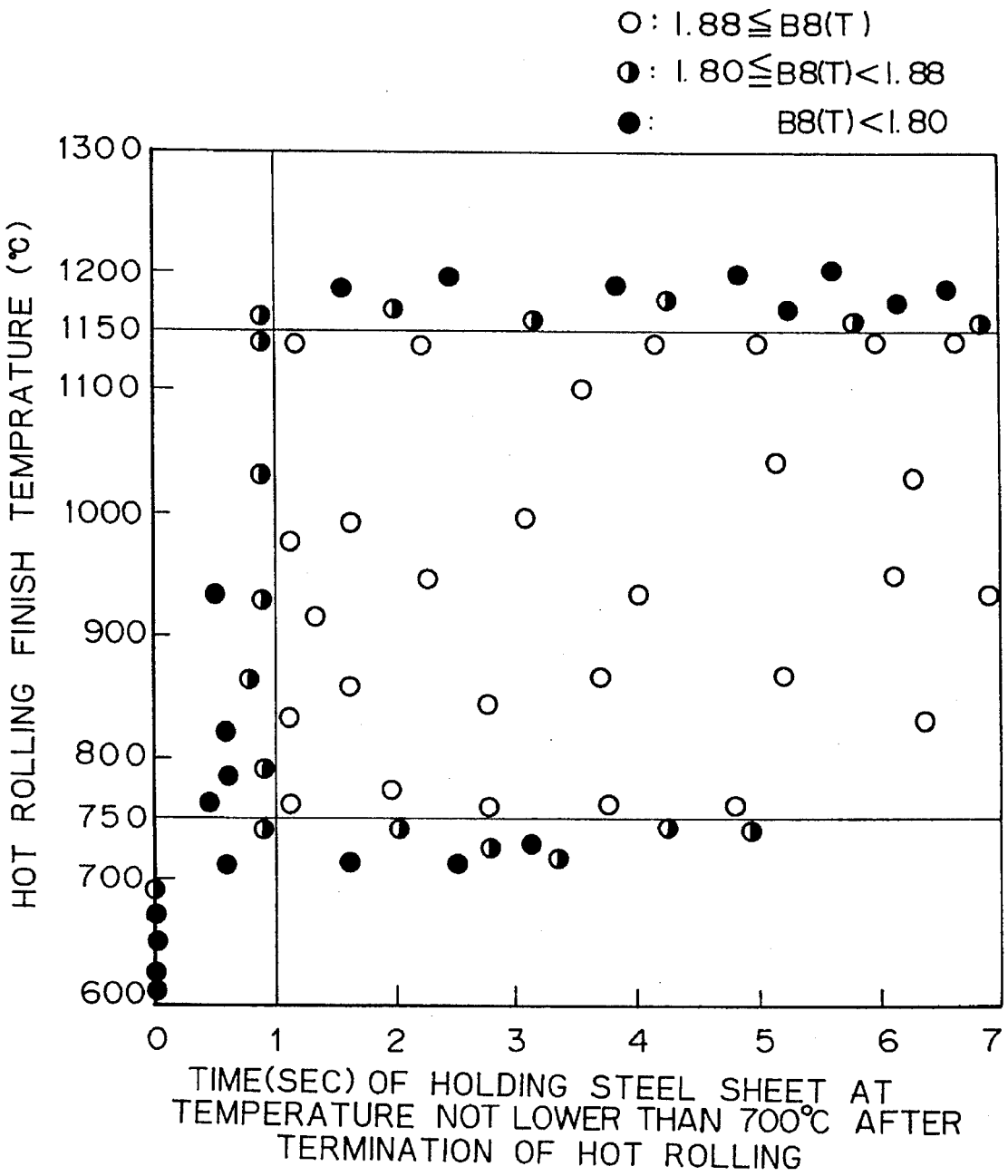
FIG. 5 is a graph showing the relationships of the hot rolling-finish temperature and the time of holding the steel sheet at a temperature not lower than 700° C. after termination of the hot rolling to the magnetic flux density of the product.

FIG. 5 is a graph showing the influences of the hot rolling-ending temperature and the time of holding the steel sheet at a temperature not lower than 700° C. after completion of hot rolling, on the magnetic flux density of the product. Namely, a slab having a thickness of 20 to 60 mm, which comprised 0.056% by weight of C, 3.27% by weight of Si, 0.028% by weight of acid-soluble Al, 0.0078% by weight of N, 0.007% by weight of S and 0.15% by weight of Mn, with the balance consisting of Fe and unavoidable impurities, was heated at 1150° to 1400° C. and hot-rolled to a hot-rolled sheet having a thickness of 2.3 mm through 6 passes. Immediately, the hot-rolled sheet was cooled with water, air-cooled for a certain time and then cooled by various means such as water cooling and air cooling, and cooling was terminated at 550° C. The sheet was subjected to a winding simulation where the sheet was held at 550° C. for 1 hour and then subjected to furnace cooling. Then, the sheet was subjected to final rolling under high reduction at a reduction ratio of about 85% without annealing of the hot-rolled steel sheet, decarburization annealing was carried out at a temperature of 830° to 1000° C., and subsequently, an anneal separating agent composed mainly of MgO was coated on the steel sheet and a final finish annealing was carried out.

As apparent from FIG. 5, when the hot rolling-finish temperature was 750° to 1150° C. and the steel sheet was held at a temperature higher than 700° C. for at least 1 second after termination of the hot rolling, a high magnetic flux density of $B_8 \geqq 1.88$ T was obtained.

The present inventors further research was based on this novel finding, in the light of the above-mentioned reduction ratio-adjusting method.

Figure 6:
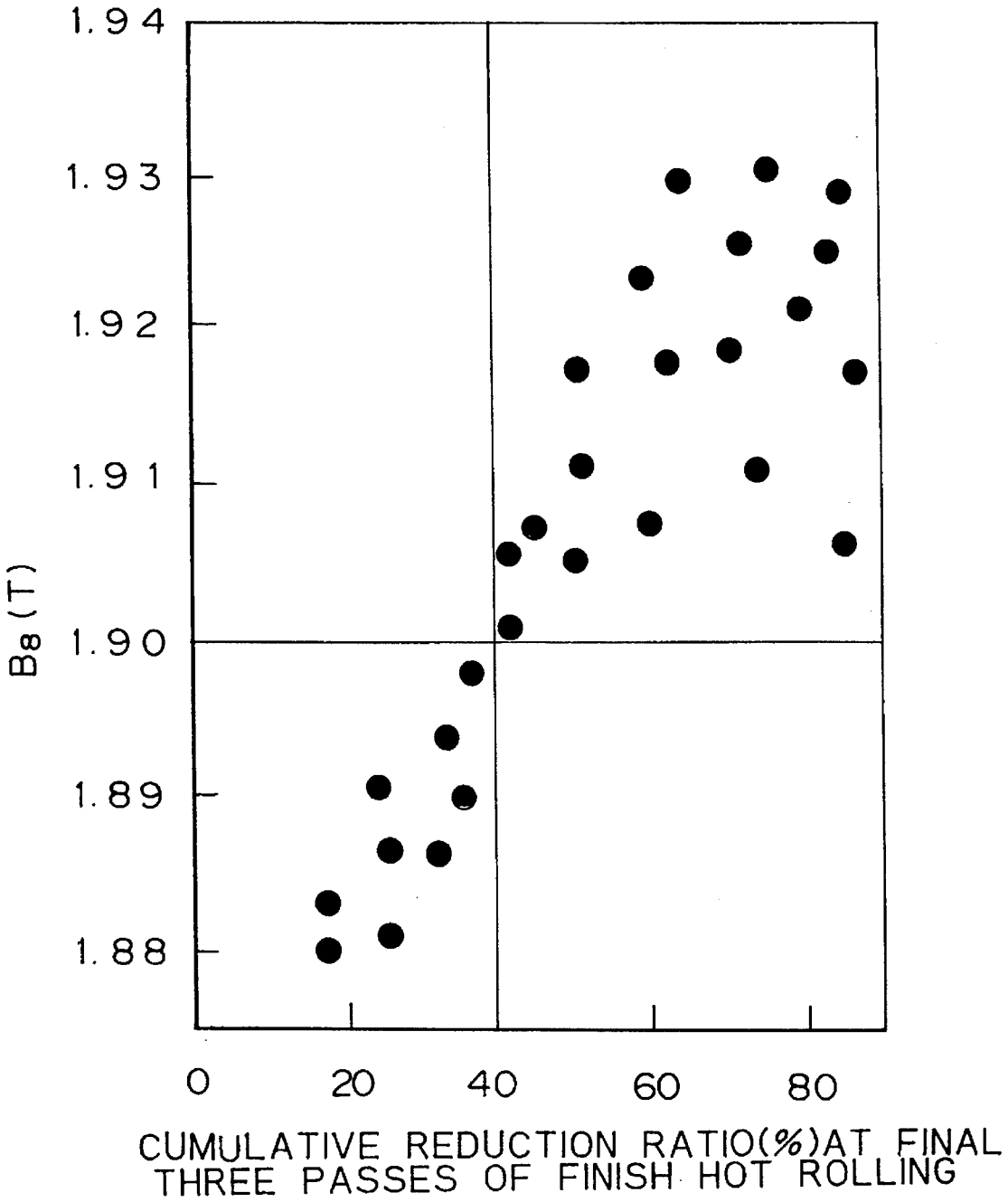
FIG. 6 is a graph illustrating the relationship of the cumulative reduction ratio at final three passes at the finish hot rolling to the magnetic flux density.

FIG. 6 shows a graph illustrating the relationship between the cumulative reduction ratio at final three passes of the finish hot rolling and the magnetic flux density, observed in runs giving a better magnetic flux density in FIG. 5, where the hot rolling-finish temperature was 750° to 1150° C. and the steel sheet was held at a temperature not lower than 700° C. for at least 1 second after the hot rolling.

As apparent from FIG. 6, when the cumulative reduction ratio at final three passes of the finish hot rolling was at least 40%, a high magnetic flux density of $B_8 \geqq 1.90$ T was obtained. The present inventors further examined this novel finding in detail.

Figure 7:
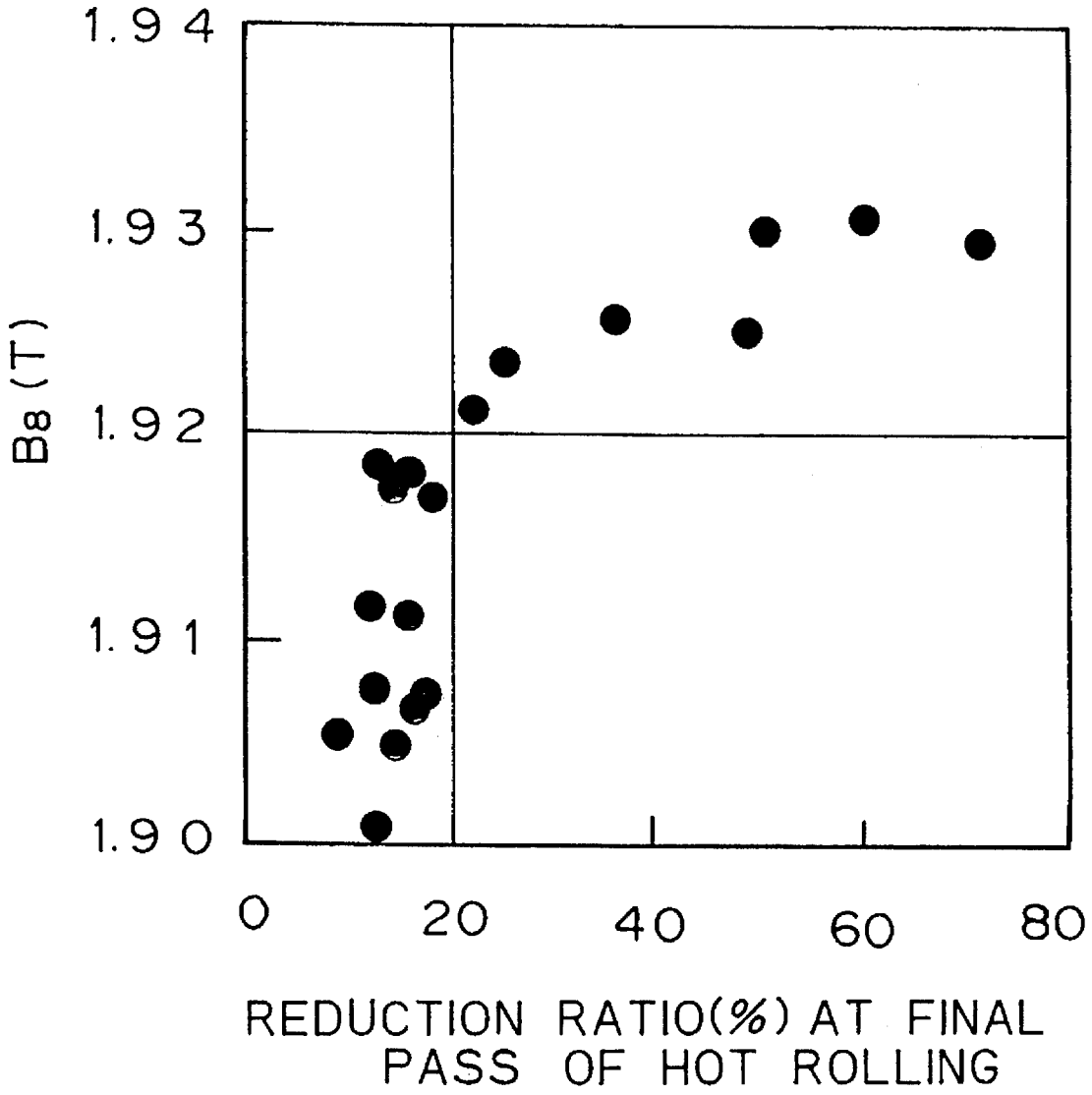
FIG. 7 is a graph illustrating the relationship of the reduction ratio at the final pass of the finish hot rolling to the magnetic flux density.

FIG. 7 is a graph showing the relationship between the reduction ratio at the final pass of the finish hot rolling and the magnetic flux density, observed in runs giving a better magnetic flux in FIG. 6, where the hot rolling-ending temperature was 750° to 1150° C., the steel sheet was held at a temperature not lower than 700° C. for at least 1 second after termination of the hot rolling and the cumulative reduction ratio at final three passes of the finish hot rolling was at least 40%.

As apparent from FIG. 7, when the reduction ratio at the final pass of the finish hot rolling was at least 20%, a high magnetic flux density of $B_8 \geqq 1.92$ T was obtained.

The reason why the relationships shown in FIGS. 5, 6 and 7 are established among the hot rolling-finish temperature, the time of holding the steel sheet at a temperature not lower than 700° C. after the hot rolling, the cumulative reduction ratio at final three passes of the finish hot rolling, the reduction ratio at the final pass of the finish hot rolling and the magnetic flux density of the product has not been completely elucidated, but it is considered that the reason is probably as follows.

Figure 8A:
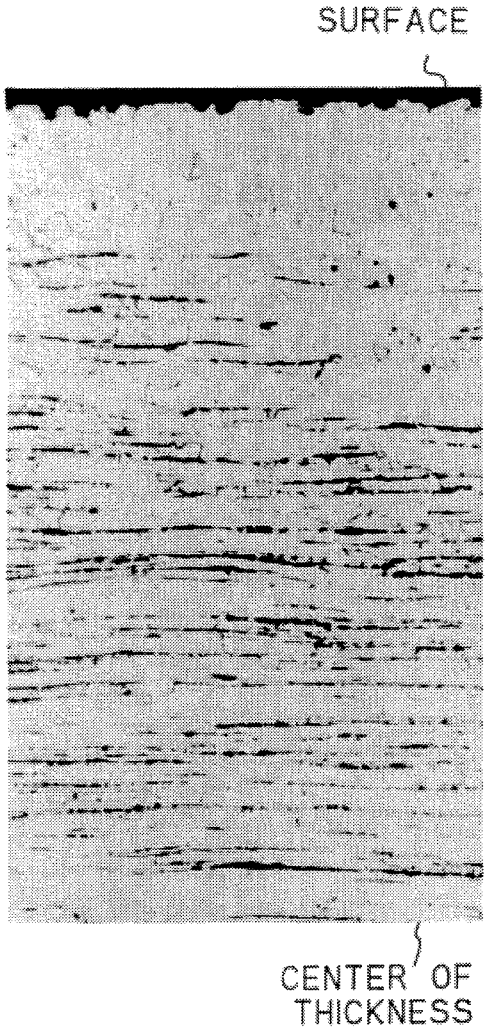
FIGS. 8(*a*) and 8(*b*) are microscope photos showing the microstructures of hot-rolled steel sheets obtained under hot rolling conditions (C) and (D), respectively.
Figure 8B:
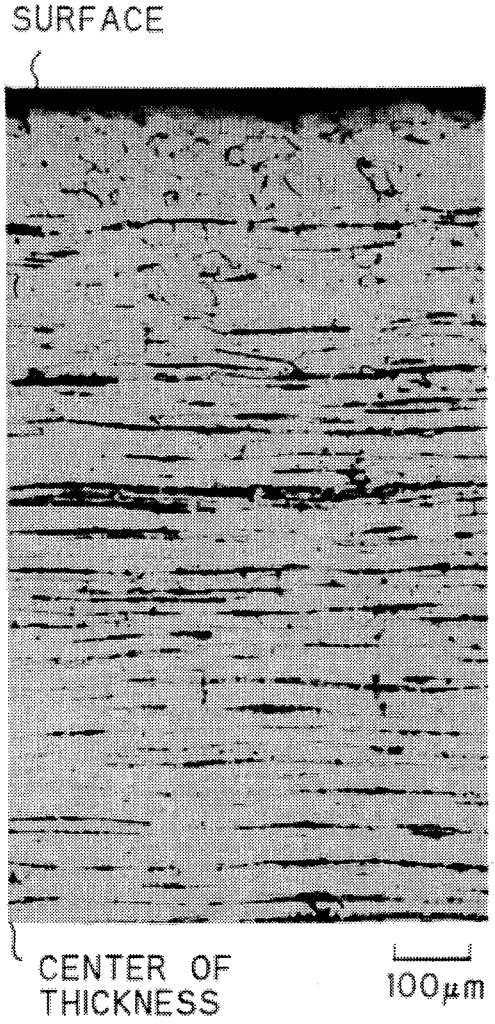

FIGS. 8(*a*) and 8(*b*) show microstructure and recrystallization ratios (at the position of ¼ thickness) of hot-rolled sheets obtained under various hot-rolling conditions. Slabs having a thickness of 26 mm and having the same composition as described above with respect to FIG. 5 were heated at 1150° C. and hot rolling was initiated at 1000° C. and the slabs were hot-rolled according to a pass schedule of 26 mm→11.8 mm→6.7 mm→3.5 mm→3.0 mm→2.6 mm→2.3 mm. The hot-rolled sheets were air-cooled for 6 seconds at a hot rolling conditions (C) or 0.2 second at a hot rolling condition (D) and then cooled to 550° C. with water at a rate of 200° C./sec, and the sheets were subjected to a winding simulation where the sheets were held at 550° C. for 1 hour and subjected to furnace cooling, whereby hot-rolled steel sheets having a thickness of 2.3 mm were obtained.

The hot rolling-finish temperature was 845° C. and the time of holding the steel sheet at a temperature higher than 700° C. was 6 seconds in the case of (C) or 0.9 second in the case of (D). The recrystallization ratio (at the position of ¼ thickness) was measured by the same method as described with respect to FIGS. 3(*a*) and 3(*b*) and 4.

As apparent from FIG. 8(*a*), when the operation was carried out under the conditions (C) specified in the present invention, the recrystallization ratio (the area ratio of low-strain grains) was high in the hot-rolled steel sheet.

It has been considered that the potential nucleus of {110}<001> secondary recrystallized grains is formed by shear deformation on the surface layer at the hot rolling, and that to enrich {100}<001> oriented grains in the hot-rolled steel sheet after cold rolling and recrystallization, a good effect can be obtained by keeping {110}<001> oriented grains in the hot-rolled steel sheet in the coarse and strain-reduced state. Separately, it is considered that the functions of customarily conducted annealing of hot-rolled sheets include precipitation of AlN and the like, formation of a transformation phase at cooling and formation of solid-dissolved C, solid-dissolved N and fine carbonitrides at cooling, and it is further considered that, in addition to these functions, a reduction of the strain by recrystallization is an important function of annealing of hot-rolled steel sheets. Regarding the effect of the present invention, it is considered that, in the production process where annealing of the hot-rolled steel sheet is not carried out, the magnetic properties of the product can be improved because of a reduction of the strain of the hot-rolled steel sheet.

Figure 9A:
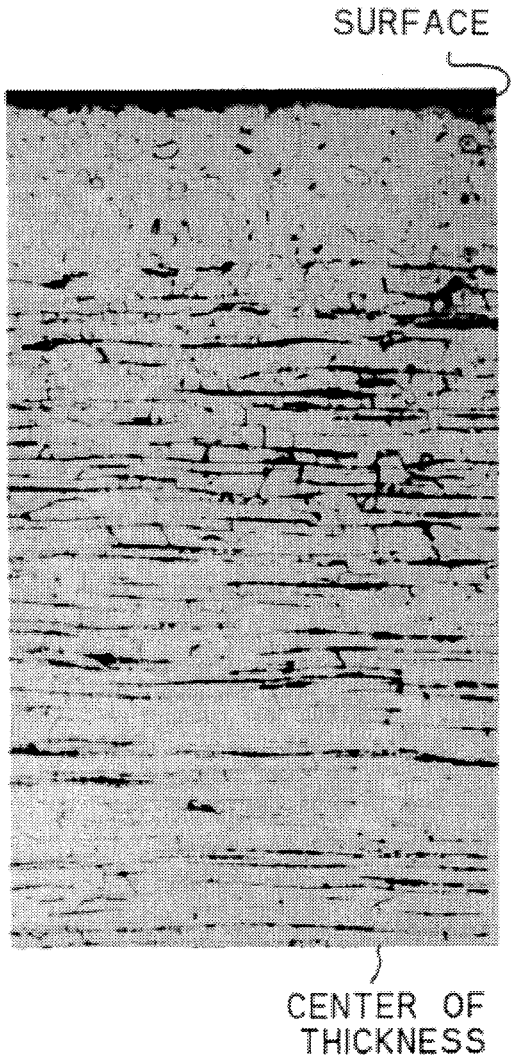
FIGS. 9(*a*) and 9(*b*) are photos showing the microstructures of hot-rolled steel sheets obtained under hot rolling conditions (E) and (F), respectively.
Figure 9B:
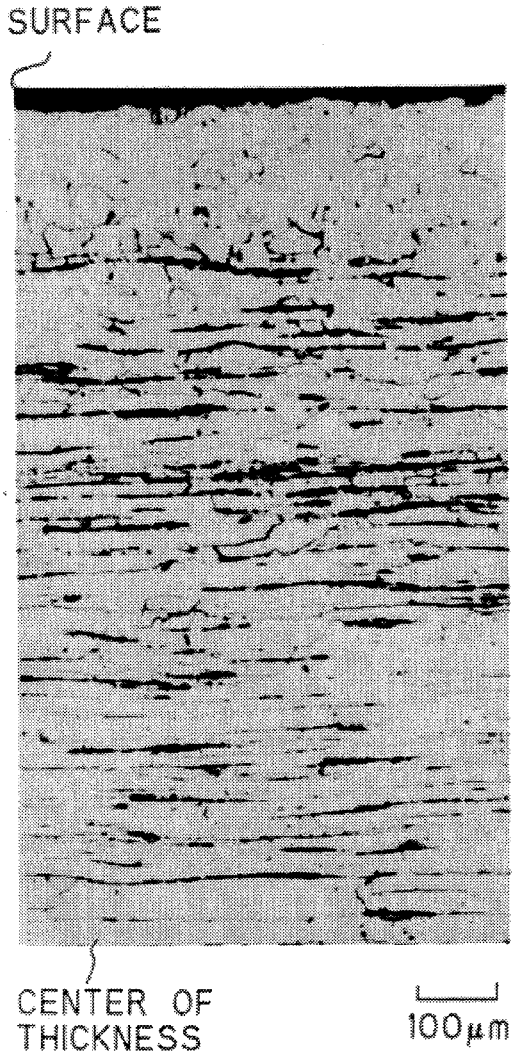

FIGS. 9(*a*) and 9(*b*) and 10 show the microstructures and recrystallization ratios (at the position of ¼ thickness) of hot-rolled steel sheets obtained under different hot-rolling conditions, and the textures (at the position of ¼ thickness) after decarburization annealing (decarburized sheets). Slabs having a thickness of 26 mm and the same composition as described above with respect to FIG. 5 were heated at 1150° C., hot rolling was initiated at 1050° C. and the slabs were hot-rolled through a pass schedule of a hot rolling conditions (E) 26 mm→20.6 mm→16.4 mm→13.0 mm→9.2 mm→4.6 mm→2.3 mm or a hot rolling conditions (F) 26 mm→11.8 mm→6.7 mm→3.5 mm→3.0 mm→2.6 mm→2.3 mm. The hot-rolled sheets were air-cooled for 2 seconds, water-cooled to 550° C. at a rate of 100° C./sec and subjected to a winding simulation where the sheets were held at 550° C. for 1 hours and subjected to furnace cooling, whereby hot-rolled steel sheets having a thickness of 2.3 mm were obtained. The hot rolling-ending temperature was 933° C. in the case of (E) or 915° C. in the case of (F), and the time of holding the steel sheet at a temperature not lower than 700° C. was 4 seconds in the case of (E) or 4 seconds in the case of (F). Then the hot-rolled steel sheets were rolled under high reduction at a reduction ratio of about 85% without performing annealing of the hot-rolled steel sheet, and the resulting cold-rolled sheets having a final thickness of 0.335 mm were subjected to decarburization annealing by holding the sheets in an atmosphere comprising 25% of $N_2$ and 75% of $H_2$ and having a dew point of 60° C. at 840° C. for 150 seconds.

Figure 10:
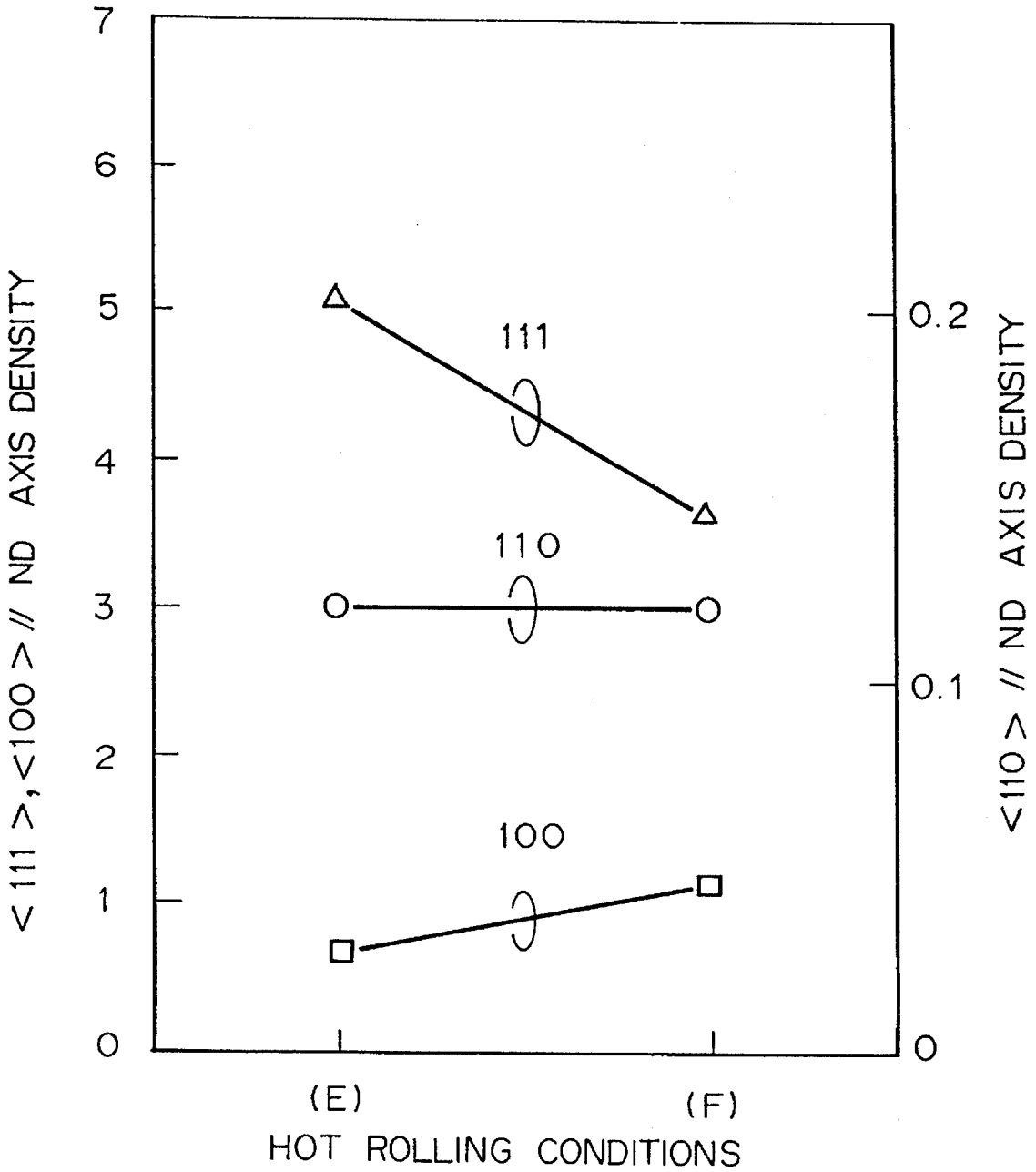
FIG. 10 is a graph showing the characteristics of the textures of decarburized sheets obtained through hot rolling conditions (E) and (F), respectively.

As apparent from FIG. 9(*a*) and 9(*b*), under the conditions (E) wherein the cumulative reduction ratio at final three passes was 82% and the reduction ratio at the final pass was 50%, the recrystallization ratio of the hot-rolled steel sheet was much higher and the crystal grain diameter was much smaller than under the conditions (F) wherein the cumulative reduction ratio at the final three passes was 34% and the reduction ratio at the final pass was 12%. Furthermore, as apparent from FIG. 10, under the conditions (E), the number of {111} oriented grains in the decarburized sheet was larger and the number of {110} oriented grains is smaller than under the conditions (F), but there was no substantial difference with respect to the number of {110} oriented grains.

In the case of the conditions (E), the crystal grain diameter of the hot-rolled steel sheet is small and the strain is reduced, and this grain diameter is disadvantageous for enriching {110}<001> oriented grains after cold rolling and recrystallization, but the conditions (E) are advantageous with respect to the strain. Consequently, no influence is imposed on {110}<001> oriented grains in the decarburized and annealed state.

Where a high reduction is applied at final three passes of the hot rolling and the holding treatment is then carried out as under the above-mentioned conditions (E), for the same reason as described above with respect to the reduction ratio-adjusting method, by the rolling under high reduction, in the decarburized state, the number of {111}<112> oriented grains advantageous for the growth of {110}<001> oriented grains is increased and the number of {100}<025> oriented grains inhibiting the growth of {110}<001> oriented grains is decreased, without any influence on {110}<001> oriented grains. Accordingly, much better magnetic properties can be obtained than the magnetic properties obtained by the above-mentioned reduction ratio-adjusting method.

The constructural requirements of the present invention will now be described.

The slab used in the present invention comprises 0.021 to 0.100% by weight of C, 2.5 to 4.5% by weight of Si and a usual inhibitor component, with the balance consisting of Fe and unavoidable impurities.

The reasons for the limitation of the contents of the foregoing components will now be described. If the content of C is lower than 0.021% by weight, the secondary recrystallization is unstable, and even if the recrystallization is effected, the magnetic flux density of $B_8$>1.80 T is difficult to obtain. Accordingly, the carbon content should be at least 0.021% by weight. If the carbon content exceeds 0.100% by weight, the decarburization becomes poor good results cannot be obtained. If the Si content exceeds 4.5% by weight, cold rolling becomes difficult and good results cannot be obtained. If the Si-content is lower than 2.5% by weight, good magnetic properties are difficult to obtain. Note, Al, N, Mn, S, Se, Sb, B, Cu, Bi, Nb, Cr, Sn, Ti and the like can be added as the inhibitor-constituting element according to need.

The slab-heating temperature is not particularly critical, but from the viewpoint of the manufacturing cost, preferably the slab-heating temperature is up to 1300° C.

The heated slab is then hot-rolled to form a hot-rolled steel sheet. The characteristic feature of the present invention resides in this hot rolling step. Namely, the hot rolling-finish temperature is adjusted at 750° to 1150° C. and the cumulative reduction ratio at final three passes is adjusted to at least 40%. If the reduction ratio at the final pass is adjusted to at least 20%, much better magnetic properties are preferably obtained.

Another characteristic feature of the present invention resides in the cooling step adjustment in which the hot rolling-ending temperature is adjusted at 750° to 1150° C., the hot-rolled steel sheet is held at a temperature not lower than 700° C. for at least 1 second after termination of the hot rolling and the winding temperature is adjusted to a level lower than 700° C. If this adjustment condition and the above-mentioned hot rolling condition of adjusting the cumulative reduction ratio at three final masses to at least 40% are simultaneously satisfied, much better magnetic properties are preferably obtained.

If the reduction ratio at the final pass is adjusted to at least 20%, much better magnetic properties are preferably obtained.

The hot rolling step of the present invention comprises heating of a slab having a thickness of 100 to 400 mm, rough rolling including a plurality of passes and finish rolling including a plurality of passes. The rough rolling method is not particularly critical and a customary method can be adopted. Still another feature of the present invention resides in the finish rolling conducted subsequently to the rough rolling, and high-speed continuous rolling comprising 4 to 10 passes is usually carried out as the finish rolling. The reduction ratio at the finish rolling is generally distributed so that the reduction ratio is higher at former stages and the reduction ratio is lowered toward latter stages to obtain a good shape. The rolling speed is usually adjusted to 100 to 3000 m/min, and the time between two adjacent passes is 0.01 to 100 seconds. The rolling conditions restricted in the present invention are only the hot rolling-finish temperature, the cumulative reduction ratio at final three passes and the reduction ratio at the final pass. Other conditions are not particularly critical, but if the time between two adjacent passes at final three passes is abnormally long and exceeds 1000 seconds, the strain is relieved by recovery and recrystallization between the passes and the effect by the cumulated strain is difficult to obtain. Accordingly, such a long time between two passes is not preferred. The reduction ratios at several passes of the former stages of the finish hot rolling are not particularly limited because it is not expected that strains given at these passes will be left at the final pass, and it is sufficient if the reduction ratios at the final three passes are taken into account.

The reasons for limiting the hot rolling conditions will now be described. The reason why the hot rolling-ending temperature is limited at 750° to 1150° C. and the cumulative reduction ratio at final three passes is adjusted to at least 40% is that as is apparent from FIG. 1, if these conditions are satisfied, a product having a good magnetic flux density $B_8$ of $B_8 \geqq 1.88$ T can be obtained. The upper limit of the cumulative reduction ratio at the final three passes is not particularly critical, but it is industrially difficult to apply a cumulative reduction ratio of at least 99.9%. The reason why the reduction ratio at the final pass is limited to at least 20% in the preferred embodiment of the present invention is that, as apparent from FIG. 2, if this condition is satisfied, a product having a much better magnetic flux density $B_8$ of $B_8 \geqq 1.90$ T can be obtained. The upper limit of the reduction ratio at the final pass is not particularly critical, but it is industrially difficult to apply a reduction ratio of at least 90% at the final pass.

The reasons for the limitation of the treatment conditions at the cooling step conducted after the hot rolling will now be described.

The reason why the hot rolling-ending temperature is 750° to 1150° C. and the hot-rolled steel sheet is held at a temperature higher than 700° C. for at least 1 second is that as is apparent from FIG. 5, if these conditions are satisfied, a product having a magnetic flux density $B_8$ of $B_8 \geqq 1.88$ T is obtained. The upper limit of the time of holding the steel sheet at a temperature not lower than 700° C. is not particularly critical, but the time of from the point of termination of the hot rolling to the point of the winding is about 0.1 to about 1000 seconds. From the viewpoint of equipment, it is difficult to hold the steel sheet in the form of a strip at a temperature not lower than 700° C. for not less than 1000 seconds.

If the winding temperature after the hot rolling is higher than 700° C., because of the difference of the heat history in the coil at the time of cooling, the deviation of the precipitation state of AlN and the like, the deviation of the surface decarburization state and the deviation of the microstructure are caused, and as the result, the deviation of magnetic properties occurs in the product. Therefore, the winding temperature should be lower than 700° C.

The reason for limiting the cumulative reduction ratio at final three passes of the finish hot rolling is as described hereinbefore with reference to the reduction ratio-adjusting method. Practically, as apparent from FIG. 6, if this condition is satisfied, a product having a better magnetic flux density of $B_8 \geqq 1.90$ T can be obtained.

Note, in this cooling step-adjusting method, the upper limit of the cumulative reduction ratio at the final three passes is not particularly critical, but it is industrially difficult to apply a cumulative reduction ratio of at least 99.9%. The reason why the reduction ratio at the final pass is limited to at least 20% in the preferred embodiment is that a product having a much better magnetic flux density $B_8$ of $B_8 \geqq 1.92$ T is obtained if this condition is satisfied, as is apparent from FIG. 7. The upper limit of the reduction ratio at the final pass is not particularly critical, but it is industrially difficult to apply a reduction ratio of at least 90%.

The hot-rolled steel sheet is cold-rolled at a reduction ratio of at least 80% without performing annealing of the hot-rolled steel sheet. The reason why the reduction ratio is adjusted to at least 80% is that if this condition is satisfied, appropriate amounts of sharp {110}<001> oriented grains and coincidence orientation grains [for example, {111}<112> oriented grains] which are readily corroded by the above grains can be obtained in the decarburized sheet, and the magnetic flux density is preferably increased.

After the cold rolling, the steel sheet was subjected to decarburization annealing, coating with an anneal separating agent and finish annealing according to customary procedures, and a final product is obtained. In the case where the inhibitor strength necessary for the secondary recrystallization in the state after the decarburization annealing is insufficient, it is necessary to reinforce the inhibitor at the finish annealing step or the like. As the inhibitor-reinforcing method, a method is known in which, in the case of an Al-containing steel, the nitrogen pressure in a finish annealing atmosphere gas is set at a higher level.

The present invention will now be described with reference to the following examples, that by no means limited the scope of the invention.

EXAMPLE 1

A slab having a thickness of 40 mm and comprising 0.054% by weight of C, 3.25% by weight of Si, 0.16% by weight of Mn, 0.005% by weight of S, 0.026% by weight of acid-soluble Al and 0.0078% by weight of N, with the balance comprising Fe and unavoidable impurities, was heated at 1150° C. Hot rolling was initiated at 1050° C. and the slab was hot-rolled through six passes to obtain a hot-rolled steel sheet having a thickness of 2.3 mm. The reduction ratio distribution adopted was (1) 40 mm→15 mm→7 mm→3.5 mm→3 mm→2.6 mm→2.3 mm, (2) 40 mm→30 mm→20 mm→10 mm→5 mm→2.8 mm→2.3 mm or (3) 40 mm→30 mm→20 mm→10 mm→5 mm→3 mm→2.3 mm. After the hot rolling, the sheet was air-cooled for 1 second, water-cooled to 550° C. and subjected to a winding simulation where the sheet was held at 550° C. for 1 hour and then subjected to furnace cooling. The obtained hot-rolled sheet was pickled and cold-rolled at a reduction ratio of about 85% to obtain a cold-rolled sheet having a thickness of 0.335 mm, and the cold-rolled sheet was subjected to decarburization annealing by holding the sheet at 830° C. for 150 seconds. The obtained decarburized and annealed sheet was coated with an anneal separating agent composed mainly of MgO. Then the sheet was subjected to final finish annealing by elevating the temperature to 1200° C. at a rate of 10° C./hr in an atmosphere gas comprising 25% of $N_2$ and 75% of $H_2$ and holding the sheet in an atmosphere gas comprising 100% of $H_2$ at 1200° C. for 20 hours.

The hot rolling conditions, the hot rolling finish temperature and the magnetic properties of the product were as shown in Table 1.

TABLE 1

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 880 | 34 | 12 | 1.83 | comparison |
| (2) | 912 | 77 | 18 | 1.89 | present invention |
| (3) | 925 | 77 | 23 | 1.91 | present invention |

EXAMPLE 2

A slab having a thickness of 26 mm and comprising 0.055% by weight of C, 3.28% by weight of Si, 0.15% by weight of Mn, 0.007% by weight of S, 0.028% by weight of acid-soluble Al and 0.0080% by weight of N, with the balance consisting of Fe and unavoidable impurities, was heated at 1150° C. and hot-rolled through 6 passes to obtain a hot-rolled sheet having a thickness of 2.3 mm. The reduction ratio distribution adopted was 26 mm→15 mm→10 mm→7 mm→5 mm→2.8 mm→2.3 mm, and the hot rolling-starting temperature was (1) 1000° C., (2) 900° C., (3) 800° C. or (4) 700° C. The conditions for the cooling after the hot rolling and the subsequent steps up to the final finish annealing were the same as described in Example 1.

The hot rolling conditions, the hot rolling-ending temperature and the magnetic properties of the product were as shown in Table 2.

TABLE 2

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 906 | 67 | 18 | 1.88 | present invention |
| (2) | 830 | 67 | 18 | 1.88 | present invention |
| (3) | 741 | 67 | 18 | 1.85 | comparison |
| (4) | 668 | 67 | 18 | 1.70 | comparison |

EXAMPLE 3

A slab having a thickness of 40 mm and comprising 0.058% by weight of C, 3.30% by weight of Si, 0.15% by weight of Mn, 0.006% by weight of S, 0.030% by weight of acid-soluble Al and 0.0081% by weight of N, with the balance consisting of Fe and unavoidable impurities, was heated at 1250° C. and hot-rolled through 6 passes to obtain a hot-rolled steel sheet having a thickness of 2.0 mm. The reduction ratio distribution adopted was 40 mm→30 mm→20 mm→10 mm→5 mm→3 mm→2 mm, and the hot rolling-starting temperature was (1) 1250° C., (2) 1100° C. or (3) 1000° C. After the hot rolling, the sheet was cooled under the same conditions as described in Example 1, and the obtained hot-rolled steel sheet was pickled and cold-rolled at a reduction ratio of about 86% to obtain a cold-rolled sheet having a thickness of 0.285 mm. The cold-rolled sheet was held at 830° C. for 120 seconds and then held at 910° C. for 20 seconds to effect decarburization annealing. The obtained decarburized and annealed steel sheet was coated with an anneal separating agent composed mainly of MgO. Then the temperature was elevated to 880° C. at a rate of 10° C./hr in an atmosphere comprising 25% of $N_2$ and 75% of $H_2$, and thereafter, the temperature was elevated to 1200° C. at a rate of 15° C./hr in an atmosphere comprising 75% of $N_2$ and 25% of $H_2$ and the sheet was held in an atmosphere gas comprising 100% of $H_2$ at 1200° C. for 20 hours to effect a final finish annealing.

The hot rolling conditions, the hot rolling-ending temperature, and the magnetic properties were as shown in Table 3.

TABLE 3

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 1171 | 80 | 33 | 1.85 | comparison |
| (2) | 985 | 80 | 33 | 1.89 | present invention |
| (3) | 915 | 80 | 33 | 1.90 | present invention |

EXAMPLE 4

A slab having a thickness of 40 mm and comprising 0.052% by weight of C, 3.21% by weight of Si, 0.14% by weight of Mn, 0.006% by weight of S, 0.031% by weight of acid-soluble Al and 0.0079% by weight of N, with the balance consisting of Fe and unavoidable impurities, was heated at 1150° C., and hot rolling was initiated at 1050° C. and the slab was hot-rolled through 6 passes to obtain a hot-rolled steel sheet having a thickness of 1.8 mm. The reduction ratio distribution adopted was (1) 40 mm→16 mm→7 mm→2.9 mm→2.5 mm→2.1 mm→1.8 mm, (2) 40 mm→30 mm→20 mm→10 mm→5 mm→2.5 mm→1.8 mm, (3) 40 mm→30 mm→22 mm→12 mm→6 mm→3.5 mm→1.8 mm, or (4) 40 mm→30 mm→22 mm→16 mm→8 mm→4 mm→1.8 mm. After the hot rolling, cooling was carried out under the same conditions as described in Example 1. The hot-rolled sheet was pickled and cold-rolled at a reduction ratio of about 86% to obtain a cold-rolled sheet having a thickness of 0.260 mm. Subsequently, the operations up to the final finish annealing were carried out under the same conditions as described in Example 1.

The hot rolling conditions, the hot rolling-ending temperature, and the magnetic properties of the product were as shown in Table 4.

TABLE 4

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 885 | 38 | 14 | 1.84 | comparison |
| (2) | 903 | 82 | 28 | 1.90 | present invention |
| (3) | 922 | 85 | 49 | 1.92 | present invention |
| (4) | 951 | 89 | 55 | 1.91 | present invention |

EXAMPLE 5

A slab having a thickness of 26 mm and comprising 0.033% by weight of C, 3.25% by weight of Si, 0.14% by weight of Mn, 0.006% by weight of S, 0.027% by weight of acid-soluble Al and 0.0078% by weight of N, with the balance consisting of Fe and unavoidable impurities, was heated at 1150° C., and hot rolling was initiated at 1050° C. and the slab was hot-rolled through six passes to obtain a hot-rolled steel sheet having a thickness of 2.3 mm. The reduction ratio distribution adopted was (1) 26 mm→10 mm→5 mm→3.5 mm→3 mm→2.6 mm→2.3 mm or (2) 26 mm→15 mm→10 mm→7 mm→5 mm→3 mm→2.3 mm. The conditions for cooling after the hot rolling and the subsequent operations up to the decarburization and annealing were the same as described in Example 1. The obtained decarburized and annealed steel sheet was coated with an anneal separating agent composed mainly of MgO. Then, the temperature was elevated to 880° C. at a rate of 10° C./hr in an atmosphere comprising 25% of $N_2$ and 75% of $H_2$, and thereafter, the temperature was elevated to 1200° C. at a rate of 10° C./hr in an atmosphere gas comprising 75% of $N_2$ and 25% of $H_2$ and the steel sheet was held in an atmosphere gas comprising 100% of $H_2$ at 1200° C. for 20 hours.

The hot rolling conditions, the hot rolling-ending temperature, and the magnetic properties of the product were as shown in Table 5.

TABLE 5

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 887 | 34 | 12 | 1.83 | comparison |
| (2) | 925 | 77 | 23 | 1.89 | present invention |

EXAMPLE 6

A slab having a thickness of 40 mm and comprising 0.078% by weight of C, 3.25% by weight of Si, 0.073% by weight of Mn, 0.025% by weight of S, 0.027% by weight of acid-soluble Al, 0.0081% by weight of N, 0.10% by weight of Sn and 0.06% by weight of Cu, with the balance consisting of Fe and unavoidable impurities, was heated at 1300° C., and the hot rolling was initiated at 1050° C. and carried out through 6 passes to obtain a hot-rolled steel sheet having a thickness of 2.3 mm. The reduction ratio distribution adopted was (1) 40 mm→15 mm→7 mm→3.5 mm→3 mm→2.6 mm→2.3 mm or (2) 40 mm→30 mm→20 mm→10 mm→6 mm→3.6 mm→2.3 mm. Cooling after the hot rolling and the operations up to the cold rolling were carried out under the same conditions as described in Example 1. The cold-rolled steel sheet was held at 830° C. for 120 seconds and then held at 950° C. for 20 seconds to effect decarburization annealing. Then the operations up to the final finish annealing were carried out under the same conditions as described in EXAMPLE 1.

The hot rolling conditions, the hot rolling-ending temperature, and the magnetic properties of the product were as shown in Table 6.

TABLE 6

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 895 | 34 | 12 | 1.82 | comparison |
| (2) | 931 | 77 | 36 | 1.91 | present invention |

EXAMPLE 7

A slab having a thickness of 26 mm and comprising 0.045% by weight of C, 3.20% by weight of Si, 0.065% by weight of Mn, 0.023% by weight of S, 0.08% by weight of Cu and 0.018% by weight of Sb, with the balance consisting of Fe and unavoidable impurities, was heated at 1300° C., and hot rolling was initiated at 1050° C. and carried out through 6 passes to obtain a hot-rolled steel sheet having a thickness of 2.3 mm. The reduction ratio distribution adopted was (1) 40 mm→15 mm→7 mm→3.5 mm→3 mm→2.6 mm→2.3 mm or (2) 40 mm→30 mm→20 mm→12 mm→8 mm→4 mm→2.3 mm. Cooling after the hot rolling and operations up to the cold rolling were carried out under the same conditions as described in Example 1. Then the cold-rolled sheet was held at 830° C. for 120 seconds and at 910° C. for 20 seconds to effect decarburization annealing. Subsequent operations up to final finish annealing were carried under the same conditions as described in Example 1.

The hot rolling conditions, the hot-rolling-ending temperature, and the magnetic properties of the product were as shown in Table 7.

TABLE 7

| Hot Rolling Conditions | Hot Rolling-Finish Temperature (°C.) | Cumulative Reduction Ratio (%) at Final Three Passes | Reduction Ratio (%) at Final Pass | $B_8$ (T) | Remarks |
|---|---|---|---|---|---|
| (1) | 893 | 34 | 12 | 1.82 | comparison |

TABLE 7-continued

| | | | | | |
|---|---|---|---|---|---|
| (2) | 942 | 81 | 43 | 1.91 | present invention |

EXAMPLE 8

A slab having a thickness of 40 mm and comprising 0.052% by weight of C, 3.25% by weight of Si, 0.16% by weight of Mn, 0.005% by weight of S, 0.028% by weight of acid-soluble Al and 0.0079% by weight of N, with the balance consisting of Fe and unavoidable impurities, was heated at 1150° C., and hot rolling was initiated at 1000° C. and carried out through a pass schedule of 40 mm→15 mm→7 mm→3.5 mm→3 mm→2.6 mm→2.3 mm to obtain a hot-rolled steel sheet having a thickness of 2.3 mm. The hot rolling-finish temperature was 855° C. Then, the sheet was subjected to (1) a winding simulation in which the sheet was air-cooled (853° C.) for 0.2 second, water-cooled to 550° C. at a rate of 250° C./sec, held at 550° C. for 1 hour and subjected to furnace cooling, or (2) a winding simulation in which the sheet was air-cooled (805°) for 5 seconds, water-cooled to 550° C. at a rate of 100° C./sec, held at 550° C. for 1 hour, and subjected to furnace cooling.

The hot-rolled steel sheet was pickled and cold-rolled at a reduction ratio of about 85% to obtain a cold-rolled sheet having a thickness of 0.335 mm, and the cold-rolled steel sheet was held at 830° C. for 150 seconds to effect decarburization annealing. The obtained decarburized and annealed steel sheet was coated with an anneal separating agent composed mainly of MgO, and the temperature was elevated to 1200° C. at a rate of 10° C./hr in an atmosphere gas comprising 25% of $N_2$ and 75% of $H_2$ and the sheet was held at 1200° C. in an atmosphere comprising 100% of $H_2$ for 20 hours to effect a final finish annealing.

The heat rolling conditions and the magnetic properties of the product were as shown in Table 8.

TABLE 8

| Hot Rolling Conditions | Hot Rolling-Finish Temperature (°C.) | Time (sec) of Maintenance of Temperature not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|
| (1) | 855 | 0.8 | 550 | 34 | 12 | 1.84 | comparison |
| (2) | 855 | 6 | 550 | 34 | 12 | 1.89 | present invention |

EXAMPLE 9

A slab having a thickness of 26 mm and comprising 0.055% by weight of C, 3.26% by weight of Si, 0.15% by weight of Mn, 0.007% by weight of S, 0.028% by weight of acid-soluble Al and 0.0081% by weight of N, with the balance consisting of Fe and unavoidable impurities, was heated at 1150° C. and hot-rolled through six passes to obtain a hot-rolled steel sheet having a thickness of 2.3 mm. The reduction ratio distribution adopted was 26 mm→15 mm→10 mm→7 mm→5 mm→2.8 mm→2.3 mm, and the hot rolling was initiated at (1) 1000° C., (2) 900° C., (3) 800° C. or (4) 700° C. After the hot rolling, the hot-rolled steel sheet was subjected to a winding simulation in which the sheet was air-cooled for 3 seconds, water-cooled to 550° C.

at a rate of 100° C./sec, held at 550° C. for 1 hour, and subjected to furnace cooling. The subsequent operations up to final finish annealing were carried out under the same conditions as described in Example 8.

The hot rolling conditions and the magnetic properties of the product were as shown in Table 9.

TABLE 9

| Hot Rolling Conditions | Hot Rolling-Finish Temperature (°C.) | Water Cooling-Initiating Temperature (°C.) | Time (sec) of Maintenance of Temperature not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 903 | 872 | 5 | 550 | 67 | 18 | 1.90 | present invention |
| (2) | 834 | 804 | 4 | 550 | 67 | 18 | 1.91 | present invention |
| (3) | 738 | 703 | 3 | 550 | 67 | 18 | 1.90 | present invention |
| (4) | 659 | 621 | 0 | 550 | 67 | 18 | 1.73 | comparison |

EXAMPLE 10

A slab having a thickness of 40 mm and comprising 0.054% by weight of C, 3.20% by weight of Si, 0.14% by weight of Mn, 0.006% by weight of S, 0.029% by weight of acid-soluble Al and 0.0082% by weight of N, with the balance consisting of Fe and unavoidable impurities, was heated at 1150° C., and hot rolling was initiated at 1000° C. and carried out through a pass schedule of 40 mm→30 mm→20 mm→10 mm→5 mm→3 mm→2 mm. After the hot rolling, the hot-rolled sheet was (1) air-cooled for 2 seconds, water-cooled to 550° C. at a rate of 100° C./sec, held at 550° C. for 1 hour and subjected to furnace cooling, or (2) air-cooled for 2 seconds, water-cooled to 750° C. at a rate of 50° C./sec, held at 750° C. for 1 hour and subjected to furnace cooling. The hot-rolled sheet was picked without annealing of the hot-rolled sheet, and the subsequent operations up to final finish annealing were carried out under the same conditions as described in Example 8.

The hot rolling conditions and the magnetic properties of the product were as shown in Table 10.

TABLE 10

| Hot Rolling Conditions | Hot Rolling-Finish Temperature (°C.) | Water Cooling-Initiating Temperature (°C.) | Time (sec) of Maintenance of Temperature not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 913 | 895 | 4 | 550 | 80 | 33 | 1.92 | present invention |
| (2) | 913 | 895 | 7205 | 750 | 80 | 33 | 1.84 | comparison |

EXAMPLE 11

A slab having a thickness of 40 mm and comprising 0.058% by weight of C, 3.40% by weight of Si, 0.15% by weight of Mn, 0.006% by weight of S, 0.031% by weight of acid-soluble Al and 0.0084% by weight of N, with the balance consisting of Fe and unavoidable impurities, was heated at 1250° C. and hot-rolled through six passes to obtain a hot-rolled steel sheet having a thickness of 2.0 mm. The reduction ratio distribution adopted was 40 mm→30 mm→20 mm→10 mm→5 mm→3 mm→2 mm and the hot rolling-initiating temperature was (1) 1250° C., (2) 1100° C. or (3) 1000° C. After the hot rolling, the hot-rolled sheet was cooled under the same conditions as described in Example 9. The hot-rolled steel sheet was pickled and cold-rolled at a reduction ratio of about 86% to obtain a cold-rolled sheet having a thickness of 0.285 mm. The cold-rolled steel sheet was held at 830° C. for 120 seconds and at 900° C. for 20 seconds to effect decarburization annealing. The obtained decarburized and annealed sheet was coated with an anneal separating agent, and the temperature was elevated to 880° C. at a rate of 10° C./hr in an atmosphere gas comprising 25% of $N_2$ and 75% of $H_2$, and thereafter, the temperature was elevated to 1200° C. at a rate of 15° C./hr in an atmosphere gas comprising 75% of $N_2$ and 25% of $H_2$. Then the sheet was held at 1200° C. for 20 hours in an atmosphere gas comprising 100% of $H_2$ to effect final finish annealing.

The hot rolling conditions and the magnetic properties of the product were as shown in Table 11.

TABLE 11

| Hot Rolling Conditions | Hot Rolling-Finish Temperature (°C.) | Water Cooling-Initiating Temperature (°C.) | Time (sec) of Maintenance of Temperature not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 1174 | 1148 | 7 | 550 | 80 | 33 | 1.85 | comparison |
| (2) | 988 | 959 | 6 | 550 | 80 | 33 | 1.93 | present invention |
| (3) | 910 | 885 | 5 | 550 | 80 | 33 | 1.92 | present invention |

EXAMPLE 12

A slab having a thickness of 40 mm and comprising 0.078% by weight of C, 3.25% by weight of Si, 0.079% by weight of Mn, 0.026% by weight of S, 0.027% by weight of acid-soluble Al, 0.0082% by weight of N, 0.12% by weight of Sn and 0.06% by weight of Cu, with the balance consisting of Fe and unavoidable impurities, was heated at 1300° C., and hot rolling was initiated at 1050° C. and carried out through six passes to obtain a hot-rolled steel sheet having a thickness of 2.3 mm. The reduction ratio distribution adopted was (1) 40 mm→15 mm→7 mm→3.5 mm→3 mm→2.6 mm→2.3 mm or (2) 40 mm→30 mm→20 mm→10 mm→6 mm→3.6 mm→2.3 mm. After the hot rolling, the hot-rolled steel sheet was subjected to a winding simulation in which the sheet was air-cooled for 2 seconds, water-cooled to 550° C. at a rate of 70° C./sec, held at 550° C. for 1 hour and subjected to furnace cooling. The hot-rolled steel sheet was pickled without annealing of the hot-rolled steel sheet, and then the sheet was cold-rolled at a reduction ratio of about 85% to obtain a cold-rolled steel sheet having a thickness of 0.335 mm. Then the cold-rolled sheet was held at 830° C. for 120 seconds and then at 950° C. for 20 seconds to effect decarburization annealing. The subsequent operations up to final finish annealing were carried out under the same conditions as described in Example 8.

The hot rolling conditions and the magnetic properties of the product were as shown in Table 12.

TABLE 12

| Hot Rolling Conditions | Hot Rolling-Finish Temperature (°C.) | Water Cooling-Initiating Temperature (°C.) | Time (sec) of Maintenance of Temperature not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 897 | 875 | 5 | 550 | 34 | 12 | 1.88 | present invention |
| (2) | 935 | 918 | 5 | 550 | 77 | 36 | 1.92 | present invention |

EXAMPLE 13

A slab having a thickness of 26 mm and comprising 0.043% by weight of C, 3.25% by weight of Si, 0.067% by weight of Mn, 0.023% by weight of S, 0.08% by weight of Cu and 0.019% by weight of Sb, with the balance consisting of Fe and unavoidable impurities, was heated at 1300° C., and hot rolling was initiated at 1050° C. and carried out through six passes to obtain a hot-rolled steel sheet having a thickness of 2.3 mm. The reduction ratio distribution adopted was (1) 40 mm→15 mm→7 mm→3.5 mm→3 mm→2.6 mm→2.3 mm or 40 mm→30 mm→20 mm→12 mm→8 mm→4 mm→2.3 mm. After the hot rolling, the hot-rolled steel sheet was subjected to a winding simulation in which the sheet was air-cooled for 3 seconds, water-cooled to 550° C. at a rate of 70° C./sec, held at 550° C. for 1 hour and subjected to furnace cooling. The hot-rolled sheet was pickled without annealing of the hot-rolled sheet, and the sheet was cold-rolled at a reduction ratio of about 85% to obtain a cold-rolled steel sheet having a thickness of 0.335 mm. The cold-rolled sheet was held at 830° C. for 120 seconds and then at 910° C. for 20 seconds to effect decarburization annealing. The subsequent operations up to final finish annealing were carried out under the same conditions as described in Example 8.

The hot rolling conditions and the magnetic properties of the product were as shown in Table 13.

TABLE 13

| Hot Rolling Conditions | Hot Rolling-Finish Temperature (°C.) | Water Cooling-Initiating Temperature (°C.) | Time (sec) of Maintenance of Temperature not lower than 700° C. after Hot Rolling | Winding Temperature (°C.) | Cumulative Reduction Ratio (%) at Final Three Passes | Reduction Ratio (%) at Final Pass | $B_8$ (T) | Remarks |
|---|---|---|---|---|---|---|---|---|
| (1) | 895 | 866 | 5 | 550 | 34 | 12 | 1.89 | present invention |
| (2) | 944 | 915 | 6 | 550 | 81 | 43 | 1.92 | present invention |

We claim:

1. A process for the production of a grain oriented electrical steel sheet having superior magnetic properties, which comprises hot-rolling a slab of a silicon steel comprising 0.021 to 0.100% by weight of C, 2.5 to 4.5% by weight of Si and an inhibitor component, with the balance consisting of Fe and unavoidable impurities, wherein said hot rolling comprises a rough rolling and a finish rolling having at least three passes with a hot rolling finish temperature of 750° to 1150° C., holding the hot rolled sheet at a holding temperature which is lower than the hot rolling finish temperature but which is not lower than a temperature of about 35° C. lower than the hot rolling finish temperature for at least 1 second after termination of the hot rolling, wherein recrystallization takes place during said holding step, followed by winding of the hot rolled sheet at a winding temperature of less than 700° C., and successively subjecting the hot rolled steel sheet, without an annealing step of the hot rolled sheet after said winding step and prior to cold rolling, to cold rolling at a reduction ratio of at least 80%, decarburization annealing and final finish annealing to result in an electrical steel sheet having a magnetic flux density of 1.88 T or more.

2. A process according to claim 1, wherein the hot finish rolling comprises at least three passes, with a cumulative reduction ratio at the final three passes being at least 40%.

3. A process according to claim 1, wherein the reduction ratio of the final pass of the finish hot rolling is at least 20%.

4. The process according to claim 1, wherein the holding temperature is about 18° C. to about 35° C. lower than the hot rolling finish temperature.

* * * * *